US011950635B2

(12) United States Patent
Qiu et al.

(10) Patent No.: US 11,950,635 B2
(45) Date of Patent: Apr. 9, 2024

(54) TEMPERATURE CONTROL METHOD OF ELECTRONIC CIGARETTE, ELECTRONIC CIGARETTE AND COMPUTER STORAGE MEDIUM

(71) Applicant: CHANGZHOU PATENT ELECTRONIC TECHNOLOGY CO., LTD, Changzhou (CN)

(72) Inventors: Weihua Qiu, Jiangsu (CN); Guimei Fan, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 551 days.

(21) Appl. No.: 17/180,886

(22) Filed: Feb. 22, 2021

(65) Prior Publication Data

US 2021/0267281 A1 Sep. 2, 2021

Related U.S. Application Data

(63) Continuation-in-part of application No. PCT/CN2019/101334, filed on Aug. 19, 2019.

(30) Foreign Application Priority Data

Aug. 20, 2018 (CN) ..... 201810950218.1

(51) Int. Cl.
*A24F 40/57* (2020.01)
*A24F 40/53* (2020.01)
*A24F 40/10* (2020.01)

(52) U.S. Cl.
CPC ..... *A24F 40/57* (2020.01); *A24F 40/53* (2020.01); *A24F 40/10* (2020.01)

(58) Field of Classification Search
CPC ..... A24F 40/57; A24F 40/53; A24F 40/10
(Continued)

(56) References Cited

U.S. PATENT DOCUMENTS 9,955,735 B2 * 5/2018 Lin ..... A24F 40/57
11,000,070 B2 * 5/2021 Anton ..... A61M 15/06
(Continued)

FOREIGN PATENT DOCUMENTS

CN 101130121 A 2/2008
CN 104026742 A 9/2014
(Continued)

OTHER PUBLICATIONS

The extended European Search Report of EP Application No. 19852420.9 dated May 10, 2022.

*Primary Examiner* — Alexander Gilman
(74) *Attorney, Agent, or Firm* — Andrew C. Cheng

(57) ABSTRACT

A temperature control method of an electronic cigarette includes the following steps: when a cigarette lighting signal is received, acquiring a preset maximum duty cycle as the initial duty cycle or determining the initial duty cycle according to the current parameters of the electronic cigarette; adjusting the battery voltage according to the initial duty cycle and outputting the battery voltage to a heating element to increase the temperature of the heating element; acquiring a temperature parameter for characterizing the temperature of the heating element; when the temperature parameter of the heating element meets a preset temperature control condition, adjusting the duty cycle according to the temperature parameter of the heating element so that the heating element retains its temperature. The temperature control method can realize the effective control of the temperature of the heating element and ensure the suction effect and the suction safety.

9 Claims, 1 Drawing Sheet

(58) Field of Classification Search
USPC ..... 131/328
See application file for complete search history.

(56) References Cited

U.S. PATENT DOCUMENTS

| | | | | |
|---|---|---|---|---|
| 11,085,550 | B2 * | 8/2021 | Marsh | H02J 7/0044 |
| 2015/0359263 | A1 * | 12/2015 | Bellinger | H05B 1/0244 392/394 |
| 2017/0280779 | A1 * | 10/2017 | Qiu | G05D 23/1919 |
| 2018/0043114 | A1 * | 2/2018 | Bowen | A61M 15/003 |
| 2018/0084608 | A1 * | 3/2018 | Bernauer | H05B 1/0291 |
| 2018/0160733 | A1 * | 6/2018 | Leadley | A24F 40/65 |
| 2018/0235282 | A1 * | 8/2018 | Gao | A24F 40/53 |
| 2021/0267281 | A1 * | 9/2021 | Qiu | A24F 40/57 |

FOREIGN PATENT DOCUMENTS

| | | | |
|---|---|---|---|
| CN | 104783332 | A | 7/2015 |
| CN | 106509998 | A | 3/2017 |
| CN | 106858724 | A | 6/2017 |
| CN | 206612222 | U | 11/2017 |
| JP | 2001502542 | A | 2/2001 |
| WO | 2015192084 | A1 | 12/2015 |
| WO | 2016202028 | A1 | 12/2016 |
| WO | 2017075883 | A1 | 5/2017 |
| WO | 2018166925 | A1 | 9/2018 |

* cited by examiner

TEMPERATURE CONTROL METHOD OF ELECTRONIC CIGARETTE, ELECTRONIC CIGARETTE AND COMPUTER STORAGE MEDIUM

CROSS-REFERENCE TO RELATED APPLICATIONS

The present application is a continuation-in-part of international application No. PCT/CN2019/101334, filed on Aug. 19, 2019, which claims priority to Chinese patent application No. 201810950218.1, filed on Aug. 20, 2018, and the entire disclosures of the foregoing applications are incorporated herein by reference.

TECHNICAL FIELD

The invention relates to the technical field of electronic cigarettes, and more particularly, relates to a temperature control method of electronic cigarettes, electronic cigarettes and computer storage media.

BACKGROUND OF THE INVENTION

Electronic cigarettes usually include atomization components, batteries, cigarette holders and other components. The battery provides power to the heating element in the atomization assembly to increase the temperature of the heating element. The e-liquid in the liquid absorbing element of the atomization assembly is heated by the heating element to evaporate to produce smoke, and the smoke is inhaled into the smoker's mouth through the cigarette holder.

In the process of use, too high evaporation temperature may cause the e-liquid to produce harmful substances and dry burning phenomenon to produce special odor; too low evaporation temperature will affect the amount of smoke. Therefore, how to effectively control the temperature of the heating element to avoid the generation of special odor and harmful substances and obtain the appropriate amount of smoke, so as to ensure the suction effect and the suction safety of electronic cigarettes has become a concern in this technical field.

SUMMARY OF THE INVENTION

In view of above, the technical problem solved by the present disclosure is to provide a temperature control method for electronic cigarettes, electronic cigarettes and computer storage media, which can realize effective control of the temperature of the heating element and ensure the suction effect and the suction safety.

A temperature control method of an electronic cigarette includes:

- when a cigarette lighting signal is received, acquiring a preset maximum duty cycle as the initial duty cycle or determining the initial duty cycle according to the current parameters of the electronic cigarette;
- adjusting the battery voltage according to the initial duty cycle and outputting the battery voltage to a heating element to increase the temperature of the heating element;
- acquiring a temperature parameter for characterizing the temperature of the heating element;
- when the temperature parameter of the heating element meets a preset temperature control condition, adjusting the duty cycle according to the temperature parameter of the heating element so that the heating element retains its temperature.

In one embodiment, the current parameters of the electronic cigarette include the battery voltage and a preset temperature parameter of the heating element, determining the initial duty cycle according to the current parameters of the electronic cigarette includes the following steps:

- detecting the battery voltage and acquiring the preset temperature parameter of the heating element;
- determining the initial duty cycle according to a preset relationship between the preset temperature parameter, the battery voltage and the duty cycle.

In one embodiment, the current parameters include the battery voltage, a preset temperature parameter of the heating element, and the preset maximum duty cycle, determining the initial duty cycle according to the current parameters of the electronic cigarette includes the following steps:

- detecting the battery voltage and acquiring the preset temperature parameter of the heating element;
- determining the temporary duty cycle according to a preset relationship between the preset temperature parameter, the battery voltage and the duty cycle;
- if the difference between the temporary duty cycle and the preset maximum duty cycle is within a preset range, the preset maximum duty cycle is used as the initial duty cycle;
- if the difference between the temporary duty cycle and the preset maximum duty cycle is outside the preset range, the temporary duty cycle is used as the initial duty cycle.

In one embodiment, the preset temperature control condition includes the absolute value of the difference between the temperature parameter of the heating element and the preset temperature parameter being less than or equal to a preset threshold.

In one embodiment, when the temperature parameter of the heating element meets the preset temperature control condition, adjusting the duty cycle according to the temperature parameter of the heating element so that the heating element retains its temperature includes:

- when the absolute value of the difference between the temperature parameter of the heating element and the preset temperature parameter is less than or equal to the preset threshold, comparing the temperature parameter of the heating element with the preset temperature parameter;
- if the temperature parameter of the heating element is less than the preset temperature parameter, when the temperature parameter of the heating element is in a rising state, the current duty cycle is maintained, the duty cycle is reduced by a first amplitude, or the duty cycle is reduced to a first preset duty cycle; and when the temperature parameter of the heating element is in a decreasing state, the duty cycle is increased to a second preset duty cycle, or the duty cycle is increased by a second magnitude;
- if the temperature parameter of the heating element is greater than the preset temperature parameter, when the temperature parameter of the heating element is in a rising state, the voltage output is cut off, the duty cycle is reduced by a third amplitude, or the duty cycle is reduced to a third preset duty cycle; and when the temperature parameter of the heating element is in a decreasing state, the voltage output is cut off, the duty cycle is reduced to a fourth preset duty cycle, the duty cycle is reduced by a fourth amplitude, or the current duty cycle is maintained;

if the temperature parameter of the heating element is equal to the preset temperature parameter, the current duty cycle is maintained.

In one embodiment, the temperature control method further includes the following steps:

when the temperature parameter of the heating element does not meet the preset temperature control condition, comparing the temperature parameter of the heating element with the preset temperature parameter;

if the temperature parameter of the heating element is less than the preset temperature parameter, when the temperature parameter of the heating element is in the rising state, the current duty cycle is maintained; and when the temperature parameter of the heating element is in a decreasing state, the duty cycle is increased to a fifth preset duty cycle, or the duty cycle is increased by a fifth magnitude;

if the temperature parameter of the heating element is greater than the preset temperature parameter, when the temperature parameter of the heating element is in a rising state, the voltage output is cut off, the duty cycle is reduced by a sixth amplitude, or the duty cycle is reduced to a sixth preset duty cycle; and when the temperature parameter of the heating element is in a decreasing state, the voltage output is cut off, the duty cycle is reduced to a seventh preset duty cycle, the duty cycle is decreased by a seventh magnitude, or the current duty cycle is maintained.

In one embodiment, the temperature control method further includes the following steps:

when the duty cycle is increased to a current corresponding preset duty cycle, the duty cycle is successively increased by a first preset amplitude;

when the duty cycle is reduced to a current corresponding preset duty cycle, the duty cycle is successively decreased by a second preset amplitude.

In an embodiment, the temperature parameter is the temperature of the heating element, and acquiring the temperature parameter of the heating element includes:

detecting the temperature of the heating element through a temperature sensor; or, detecting the voltage across the heating element to calculate the resistance value of the heating element according to the detected voltage, and determining the temperature of the heating element according to a corresponding relationship between the resistance value and the temperature.

The present disclosure further provides an electronic cigarette including a memory and a processor, the memory stores therein at least one program instruction, the processor loads and executes the at least one program instruction to implement the temperature control method of the electronic cigarette as described above.

The present disclosure further provides a computer storage medium on which computer program instructions are stored; when the computer program instructions are executed by a processor, the temperature control method of the electronic cigarette as described above is implemented.

In the temperature control method of the electronic cigarette, the electronic cigarette and the computer storage medium provided by the present disclosure, when a cigarette lighting signal is received, a preset maximum duty cycle is acquired as the initial duty cycle or the initial duty cycle is determined according to the current parameters of the electronic cigarette; then, the battery voltage is adjusted according to the initial duty cycle and output to the heating element to increase the temperature of the heating element; a temperature parameter for characterizing the temperature of the heating element is acquired; when the temperature parameter of the heating element meets a preset temperature control condition, the duty cycle is adjusted according to the temperature parameter of the heating element so that the heating element retains its temperature. In this way, by using the preset maximum duty cycle as the initial duty cycle or determining the initial duty cycle according to the current parameters of the electronic cigarette, the heating element is heated, and when the preset temperature control condition is met, the duty cycle is adjusted according to the temperature parameter of the heating element so that the heating element retains its temperature. The present disclosure can realize the effective control of the temperature of the heating element based on the performance of the electronic cigarette, ensure the suction effect and the suction safety, and improve the user experience.

BRIEF DESCRIPTION OF THE DRAWINGS

Exemplary embodiments of the disclosure are described more fully hereinafter with reference to the accompanying drawings.

DETAILED DESCRIPTION OF PREFERRED EMBODIMENTS

In order to facilitate understanding of the present invention, the present invention will be described more fully below with reference to the related drawings. The drawings show the preferred embodiments of the present invention. However, the present invention can be implemented in many different forms and is not limited to the embodiments described herein. Rather, these embodiments are provided to provide a thorough understanding of the disclosure of the present invention.

It should be noted that when an element is referred to as being "fixed to" another element, it may be directly on the other element or there may be a centered element. When an element is considered to be "connected" to another element, it can be directly connected to the other element or intervening elements may also be present.

Unless defined otherwise, all technical and scientific terms used herein have the same meaning as commonly understood by one of ordinary skill in the art to which this invention belongs. The terms used herein in the description of the present invention are only for the purpose of describing specific embodiments, and are not intended to limit the present invention. The term "and/or" as used herein includes any and all combinations of one or more of the associated listed items.

Figure 1:
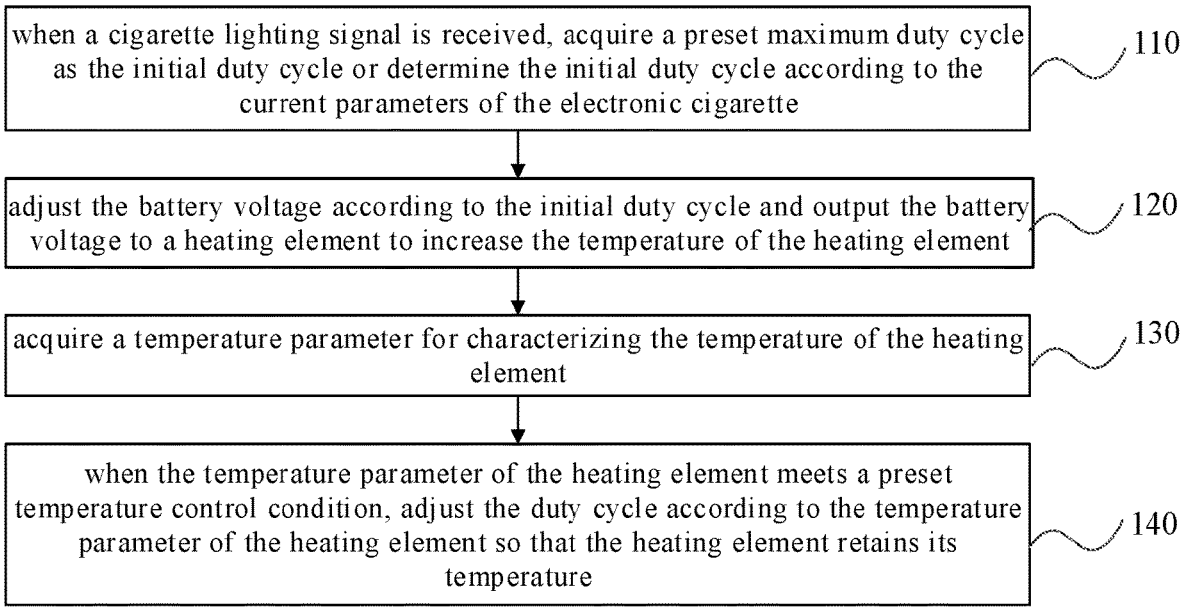
FIG. 1 is a schematic flowchart of a temperature control method of an electronic cigarette in an exemplary embodiment of the present disclosure.

FIG. 1 is a schematic flowchart of a temperature control method of an electronic cigarette in an exemplary embodiment of the present disclosure. As shown in FIG. 1, the temperature control method of the electronic cigarette of this embodiment includes:

Step 110: when a cigarette lighting signal is received, acquiring a preset maximum duty cycle as the initial duty cycle or determining the initial duty cycle according to the current parameters of the electronic cigarette.

Specifically, the user sucks the electronic cigarette to cause an airflow sensor to generate a sensor signal to trigger the cigarette lighting signal, or presses a lighting button of the electronic cigarette to trigger the cigarette lighting signal. The current parameters of the electronic cigarette reflect the current performance and status of the electronic cigarette, and include but are not limited to preset parameters and/or detected parameters. In this embodiment, the current parameters of the electronic cigarette include the battery voltage and a preset temperature parameter of a heating element, and/or the preset maximum duty cycle. Among them, the battery voltage is a detected parameter, which is used to characterize the current actual voltage of the battery. The preset temperature parameter and the preset maximum duty cycle are preset parameters. The temperature parameter is a physical quantity used to characterize the temperature of the heating element. The temperature parameter includes but is not limited to the temperature or resistance value of the heating element. There is a corresponding relationship between the resistance value of the heating element and the temperature of the heating element. For metal heating elements, the higher the temperature of the heating element, the higher the resistance value; therefore, the temperature or resistance value of the heating element can reflect the temperature state of the heating element. The preset temperature parameter is the target value for temperature control, that is, the target temperature or target resistance value corresponding to the temperature or resistance value of the heating element. The preset temperature parameter can be the default value or set by the user. In actual implementation, when the user sets a target temperature as the preset temperature parameter, the electronic cigarette can convert the target temperature to obtain the corresponding target resistance value. The target resistance value can also be used as a preset temperature parameter, so long as the preset temperature parameter is consistent with the type of the currently acquired temperature parameter. The preset maximum duty cycle is the maximum duty cycle that the e-cigarette can work set by the designer in advance. Duty cycle refers to the ratio of the power-on time to the total time in a pulse cycle. By adjusting the duty cycle, the battery voltage can be adjusted and output to realize the operating voltage of the atomizer adjustable.

In one embodiment, since the initial temperature of the heating element is lower than the preset temperature during the entire heating process; therefore, when heating is started, the preset maximum duty cycle is used as the initial duty cycle, which can make the heating element heat up quickly and improve the heating efficiency.

In one embodiment, the current parameters of the electronic cigarette include the battery voltage and the preset temperature parameter of the heating element, determining the initial duty cycle according to the current parameters of the electronic cigarette includes the following steps:

- detecting the battery voltage and acquiring the preset temperature parameter of the heating element;
- determining the initial duty cycle according to a preset relationship between the preset temperature parameter, the battery voltage and the duty cycle.

Among them, the initial duty cycle is the duty cycle used when the electronic cigarette starts working; with the change of battery usage time and usage conditions, the actual voltage of the battery may drop to a certain extent. When determining the initial duty cycle, the voltage of the battery is detected to obtain the actual voltage of the battery. The preset relationship between the preset temperature parameter, the battery voltage and the duty cycle is obtained through pre-training with experimental data.

Under the same preset temperature parameter, different battery voltages correspond to different duty cycles. The duty cycle can be the optimal duty cycle that enables the electronic cigarette to have higher heating efficiency, more suitable suction effect, and lower power consumption. The duty cycle is usually a larger duty cycle. In this way, after the battery voltage is detected, according to the preset relationship between the preset temperature parameter, the battery voltage and the duty cycle obtained by pre-training, a duty cycle can be determined as the initial duty cycle.

In one embodiment, the current parameters include the battery voltage, the preset temperature parameter of the heating element and the preset maximum duty cycle, determining the initial duty cycle according to the current parameters of the electronic cigarette includes the following steps:

- detecting the battery voltage and acquiring the preset temperature parameter of the heating element;
- determining a temporary duty cycle according to a preset relationship between the preset temperature parameter, the battery voltage and the duty cycle;
- if the difference between the temporary duty cycle and the preset maximum duty cycle is within a preset range, the preset maximum duty cycle is used as the initial duty cycle;
- if the difference between the temporary duty cycle and the preset maximum duty cycle is outside the preset range, the temporary duty cycle is used as the initial duty cycle.

Among them, when the current parameters include the battery voltage, the preset temperature parameter of the heating element and the preset maximum duty cycle, the battery voltage is detected first, and a duty cycle is determined according to the preset relationship between the preset temperature parameter, the battery voltage and the duty cycle obtained by pre-training. The duty cycle may be the optimal duty cycle that enables the electronic cigarette to have a higher heating efficiency and a more suitable suction effect as the temporary duty cycle, which is usually a relatively large duty cycle.

And then, the temporary duty cycle is compared with the preset maximum duty cycle, if the difference between the temporary duty cycle and the preset maximum duty cycle is within the preset range, the preset maximum duty cycle is used as the initial duty cycle. Conversely, if the difference between the temporary duty cycle and the preset maximum duty cycle is outside the preset range, the temporary duty cycle determined according to the preset relationship between the preset temperature parameter, the battery voltage and the duty cycle is used as the initial duty cycle. In this way, the heating efficiency of the electronic cigarette can be improved while ensuring the safe operation of the electronic cigarette, and the excessive power consumption of the electronic cigarette can also be avoided.

In step 120, adjusting the battery voltage according to the initial duty cycle and outputting the battery voltage to the heating element to increase the temperature of the heating element.

Among them, after the initial duty cycle is determined, the battery voltage is adjusted according to the initial duty cycle and then output to the heating element, and the heating element is continuously heated to increase the temperature of the heating element. The initial duty cycle is the preset maximum duty cycle or a relatively large duty cycle corresponding to the battery voltage and the preset temperature parameter, so that the heating element can be heated up quickly and the heating efficiency can be improved.

Step 130: acquiring a temperature parameter for characterizing the temperature of the heating element.

In one embodiment, the temperature parameter is the resistance of the heating element. In actual implementation, firstly, detect the voltage at both ends of the heating element, and then calculate the resistance value of the heating element according to the detected voltage; or, firstly, detect the temperature of the heating element through a temperature sensor, and then determine the resistance value of the heating element according to the corresponding relationship between the temperature and the resistance value.

In one embodiment, the temperature parameter is the temperature of the heating element, and acquiring the temperature parameter of the heating element may include:

detecting the temperature of the heating element through a temperature sensor; or, detecting the voltage across the heating element to calculate the resistance value of the heating element according to the detected voltage, and determining the temperature of the heating element according to the corresponding relationship between the resistance value and the temperature.

Among them, the temperature of the heating element can be directly detected by the temperature sensor arranged around the heating element. In addition, since the resistance value of the heating element changes with the temperature, the resistance value of the heating element can also be detected to characterize the temperature of the heating element. In actual implementation, the voltage at both ends of the heating element is first detected, and then, the resistance value of the heating element is calculated according to the detected voltage, and then the temperature of the heating element is determined according to the corresponding relationship between the resistance value and the temperature. The process of acquiring the temperature parameter of the heating element can be carried out after receiving the cigarette lighting signal. After the heating element starts to heat up, the temperature parameter can be collected every set time for real-time monitoring.

Step 140: when the temperature parameter of the heating element meets a preset temperature control condition, adjusting the duty cycle according to the temperature parameter of the heating element so that the heating element retains its temperature.

In one embodiment, the preset temperature control condition includes the absolute value of the difference between the temperature parameter of the heating element and the preset temperature parameter being less than or equal to a preset threshold; the preset threshold can be any non-negative number; the size of the preset threshold determines the accuracy of temperature control. When the preset threshold is zero, the temperature control condition is met only when the temperature parameter of the heating element is equal to the preset temperature parameter. When the preset threshold is not zero, the temperature parameter of the heating element fluctuates within the interval of the upper and lower preset thresholds of the preset temperature parameter to be considered as meeting the temperature control condition. For example, when the preset temperature parameter is 200° C. or 1Ω, the preset threshold is 3° C. or 0.01Ω, if the temperature of the heating element fluctuates between 197° C. and 203° C. or the resistance value fluctuates between 0.9952 and 1.0152, it is considered to meet the temperature control condition. In another embodiment, the temperature control condition may also be that the temperature parameter of the heating element is within a temperature parameter range lower than a first threshold value of the preset temperature parameter or higher than a second threshold value of the preset temperature parameter, the first threshold value and the second threshold value are all non-negative numbers and not equal to each other; that is, the temperature parameter of the heating element fluctuates differently within the upper and lower intervals of the preset temperature parameter. For example, when the preset temperature parameter is 200° C. or 1Ω, the first threshold is 3° C. or 0.01Ω, and the second threshold is 4° C. or 0.009Ω, if the temperature of the heating element fluctuates between 197° C. and 204° C. or the resistance value fluctuates between 0.99Ω to 1.009Ω, it is considered to meet the temperature control condition.

In one embodiment, when the temperature parameter of the heating element meets the preset temperature control condition, adjusting the duty cycle according to the temperature parameter of the heating element so that the heating element retains its temperature includes:

when the absolute value of the difference between the temperature parameter of the heating element and the preset temperature parameter is less than or equal to the preset threshold, comparing the temperature parameter of the heating element with the preset temperature parameter;

if the temperature parameter of the heating element is less than the preset temperature parameter, when the temperature parameter of the heating element is in a rising state, the current duty cycle is maintained, the duty cycle is reduced by a first amplitude, or the duty cycle is reduced to a first preset duty cycle; and when the temperature parameter of the heating element is in a decreasing state, the duty cycle is increased to a second preset duty cycle or the duty cycle is increased by a second magnitude;

if the temperature parameter of the heating element is greater than the preset temperature parameter, when the temperature parameter of the heating element is in a rising state, the voltage output is cut off, the duty cycle is reduced by a third amplitude, or the duty cycle is reduced to a third preset duty cycle; and when the temperature parameter of the heating element is in a decreasing state, the voltage output is cut off, the duty cycle is reduced to a fourth preset duty cycle, the duty cycle is reduced by a fourth amplitude, or the current duty cycle is maintained;

if the temperature parameter of the heating element is equal to the preset temperature parameter, the current duty cycle is maintained.

Among them, when the temperature parameter of the heating element meets the temperature control condition, that is, when the absolute value of the difference between the temperature parameter of the heating element and the preset temperature parameter is less than or equal to the preset threshold, there may be different situations in which the temperature parameter of the heating element is greater than, equal to, or less than the preset temperature parameter. At this time, by comparing the temperature parameter of the heating element with the preset temperature parameter, and adjusting the duty cycle according to the comparison result, the temperature control can be more accurate and effective.

Specifically, when the temperature parameter fluctuates up and down relative to the preset temperature parameter, the electronic cigarette can be in a state of cutting off voltage output, working in a high duty cycle or working in a low duty cycle according to the high or low state of the temperature parameter. Among them, when the electronic cigarette is currently in a state of cutting off the voltage output or suddenly dropping from a high duty cycle to a low duty cycle, the temperature parameter of the heating element, such as the temperature or the resistance, will drop. When the electronic cigarette is currently working at a high duty cycle or suddenly increases from a low duty cycle to a high duty cycle, the temperature parameter of the heating element, such as the temperature or the resistance, will increase.

Therefore, if the result of the numerical comparison is that the temperature parameter of the heating element is less than the preset temperature parameter, the change trend of the temperature parameter of the heating element is further determined. When the temperature parameter of the heating element is in a rising state, the current duty cycle is maintained, the duty cycle is reduced by a first amplitude, or the duty cycle is reduced to a first preset duty cycle. Among them, maintaining the current duty cycle can stably increase the temperature parameter of the heating element, reducing the duty cycle by the first magnitude or reducing the duty cycle to the first preset duty cycle can decrease the rate of increase of the temperature parameter to stably approach the preset temperature parameter. The adjustment of the duty cycle can be selected according to the difference between the temperature parameter and the preset temperature parameter and the rate of change of the temperature parameter. For example, when the temperature parameter is close to the preset temperature parameter and the rate of change is faster, the duty cycle is reduced by the first amplitude or the duty cycle is reduced to the first preset duty cycle; when the temperature parameter is close to the preset temperature parameter and the rate of change is relatively gentle, the current duty cycle can be maintained.

When the temperature parameter of the heating element is in a decreasing state, the duty cycle is increased to a second preset duty cycle or the duty cycle is increased by a second amplitude, so that the temperature parameter of the heating element decreases slowly and then changes for a steady rise. Through this way of dynamically adjusting the duty cycle, more targeted adjustments can be made according to the changing trend of the temperature parameter of the heating element within the temperature parameter interval, so that the temperature parameter of the heating element is as stable as possible close to the preset temperature parameter. In actual implementation, the first amplitude and the second amplitude can be preset amplitudes or an amplitude matching the current rate of change of the temperature parameter can be selected to ensure the stable change of the temperature parameter. In addition, the second preset duty cycle may be equal to the initial duty cycle or another large duty cycle; the first preset duty cycle is a small duty cycle or close to zero duty cycle; it can be adjusted according to the size of the preset threshold set in the temperature control condition.

If the result of the numerical comparison is that the temperature parameter of the heating element is greater than the preset temperature parameter, the change trend of the temperature parameter of the heating element is further determined. When the temperature parameter of the heating element is in a rising state, the voltage output is cut off, the duty cycle is reduced by a third amplitude, or the duty cycle is reduced to a third preset duty cycle, so that the temperature parameter of the heating element increases slowly and then turns into steady reduction; when the temperature parameter of the heating element is in a decreasing state, the voltage output is cut off, the duty cycle is reduced to a fourth preset duty cycle, the duty cycle is reduced by a fourth amplitude or the current duty cycle is maintained, so that the temperature parameter of the heating element is decreases steadily. The adjustment of the duty cycle can be selected according to the difference between the temperature parameter and the preset temperature parameter and the rate of change of the temperature parameter. Through this way of dynamically adjusting the duty cycle, more targeted adjustments can be made according to the changing trend of the temperature parameter of the heating element within the temperature parameter interval, so that the temperature parameter of the heating element is as stable as possible close to the preset temperature parameter. In actual implementation, the third amplitude and the fourth amplitude can be preset amplitudes or an amplitude matching the current rate of change of the temperature parameter can be selected to ensure the stable change of the temperature parameter. In addition, the third preset duty cycle and the fourth preset duty cycle is a small duty cycle or close to zero duty cycle, which can be specifically adjusted according to the size of the preset threshold set in the temperature control condition.

If the result of the numerical comparison is that the temperature parameter of the heating element is equal to the preset temperature parameter, the current duty cycle is maintained to make the temperature parameter of the heating element as close to the preset temperature as possible.

For example, when the preset temperature parameter is 200° C. and the preset threshold is 3° C., if the current temperature parameter of the heating element changes to 198° C., 197.5° C., 197° C., the temperature control condition is met, and the temperature parameter is less than the preset temperature parameter and is in a decreasing state. At this time, the duty cycle is increased to a second preset duty cycle or the duty cycle is increased by a second amplitude, so that the temperature parameter of the heating element is reduced slowly and then converted to a steady increase, thereby being closer to the preset temperature parameter of 200° C. If the current temperature parameter of the heating element changes to 197° C., 197.5° C., 198° C., the temperature control condition is met, and the temperature parameter is lower than the preset temperature parameter and is in a rising state. At this time, the current duty cycle is maintained, the duty cycle is reduced by a first magnitude, or the duty cycle is reduced to a first preset duty cycle, so that the temperature parameter rises steadily to be closer to the preset temperature parameter. If the current temperature parameter of the heating element changes to 201° C., 201.5° C., 202° C., the temperature control condition is met, and the temperature parameter is greater than the preset temperature parameter and is in a rising state; at this time, the voltage output is cut off, the duty cycle is reduced by a third magnitude, or the duty cycle is reduced to a third preset duty cycle, so that the increase rate of the temperature parameter of the heating element is slowed down and then converted to a steady decrease, thereby being closer to the preset temperature parameter of 200° C. If the current temperature parameter of the heating element changes to 202° C., 201.5° C., 201° C., the temperature control condition is met, and the temperature parameter is greater than the preset temperature parameter and is in a decreasing state. At this time, the voltage output is cut off, the duty cycle is reduced to a fourth preset duty cycle, the duty cycle is reduced by a fourth magnitude or the current duty cycle is maintained, so that the temperature parameter is steadily decreased to be closer to the preset temperature parameter. In this way, the adjustment process is stable and the temperature control effect is better.

In one embodiment, the temperature control method of the electronic cigarette of this embodiment may further include the following steps:

when the absolute value of the difference between the temperature parameter of the heating element and the preset temperature parameter is greater than the preset threshold, comparing the temperature parameter of the heating element with the preset temperature parameter;

if the temperature parameter of the heating element is less than the preset temperature parameter, when the temperature parameter of the heating element is in a rising state, the current duty cycle is maintained; and when the temperature parameter of the heating element is in a decreasing state, the duty cycle is increased to a fifth preset duty cycle, or the duty cycle is increased by a fifth amplitude;

if the temperature parameter of the heating element is greater than the preset temperature parameter, when the temperature parameter of the heating element is in a rising state, the voltage output is cut off, the duty cycle is reduced by a sixth amplitude, or the duty cycle is reduced to a sixth preset duty cycle; and when the temperature parameter of the heating element is in a decreasing state, the voltage output is cut off, the duty cycle is reduced to a seventh preset duty cycle, the duty cycle is reduced by a seventh magnitude, or the current duty cycle is maintained.

Among them, when the temperature parameter of the heating element does not meet the preset temperature control condition, that is, the absolute value of the difference between the temperature parameter of the heating element and the preset temperature parameter is greater than the preset threshold, there may be the temperature parameter of the heating element greater than or less than the preset temperature parameter; at this time, by comparing the temperature parameter of the heating element with the preset temperature parameter, and adjusting the duty cycle according to the comparison result, the temperature parameter control can be more accurate and effective.

Specifically, when the temperature parameter exceeds the range that the preset temperature parameter fluctuates, the electronic cigarette may be in the state of cutting off the voltage output, working at a high duty cycle, or working at a low duty cycle according to the high or low state of the temperature parameter. Among them, when the electronic cigarette is currently in the state of cutting off the voltage output or suddenly dropping from a high duty cycle to a low duty cycle, the temperature parameter of the heating element, for example, the temperature or the resistance may drop significantly and cause the temperature control range to be exceeded. When the electronic cigarette is currently working at a high duty cycle or suddenly increases from a low duty cycle to a high duty cycle, the temperature parameter of the heating element, such as the temperature or the resistance, may increase significantly and cause the temperature control range to be exceeded.

Therefore, if the result of the numerical comparison is that the temperature parameter of the heating element is less than the preset temperature parameter, the change trend of the temperature parameter of the heating element is further determined. When the temperature parameter of the heating element is in a rising state, the current duty cycle is maintained, so that the temperature parameter of the heating element rises steadily until it meets the temperature control condition.

When the temperature parameter of the heating element is in a decreasing state, the duty cycle is increased to a fifth preset duty cycle or the duty cycle is increased by a fifth amplitude, so that the temperature parameter of the heating element is decreased slowly and then converted to a steady increase until it meets the temperature control condition. The duty cycle adjustment can be selected according to the difference between the temperature parameter and the preset temperature parameter and the rate of change of the temperature parameter. In this way, more targeted adjustments can be made according to the change trend of the temperature parameter of the heating element, so that the temperature parameter of the heating element can still approach the preset temperature parameter as smoothly as possible when it does not meet the temperature control condition. In actual implementation, the fifth amplitude can be a preset amplitude or select an amplitude that matches the current rate of change of the temperature parameter to ensure the smooth change of the temperature parameter. In addition, the fifth preset duty cycle can be equal to the initial duty cycle or another large duty cycle, which can be specifically adjusted according to the size of the preset threshold set in the temperature control condition.

If the result of the numerical comparison is that the temperature parameter of the heating element is greater than the preset temperature parameter, the change trend of the temperature parameter of the heating element is further determined. When the temperature parameter of the heating element is in a rising state, the voltage output is cut off, the duty cycle is reduced by a sixth amplitude, or the duty cycle is reduced to a sixth preset duty cycle, so that the temperature parameter of the heating element rises slowly and then converts to decrease steadily until it meets the temperature control condition, the adjustment of the duty cycle can be selected according to the difference between the temperature parameter and the preset temperature parameter and the rate of change of the temperature parameter. When the temperature parameter of the heating element is in a decreasing state, the voltage output is cut off, the duty cycle is reduced to a seventh preset duty cycle, the duty cycle is reduced by a seventh amplitude, or the current duty cycle is maintained, so that the temperature parameter of the heating element drops steadily until it meets the temperature control condition. The duty cycle adjustment can be selected according to the difference between the temperature parameter and the preset temperature parameter and the rate of change of the temperature parameter. In this way, more targeted adjustments can be made according to the change trend of the temperature parameter of the heating element, so that the temperature parameter of the heating element can still approach the preset temperature parameter as smoothly as possible when it does not meet the temperature control condition. In actual implementation, the sixth and seventh amplitudes can be preset amplitudes or select an amplitude that matches the current rate of change of the temperature parameter to ensure the smooth change of the temperature parameter. In addition, the sixth preset duty cycle and the seventh preset duty cycle are a small duty cycle or close to zero duty cycle, which can be specifically adjusted according to the size of the preset threshold set in the temperature control condition.

For example, when the preset temperature parameter is 200° C. and the preset threshold is 3° C., if the current temperature parameter of the heating element changes to 196° C., 195.5° C., 195° C., the temperature control condition is not met, and the temperature parameter is less than the preset temperature parameter and is in a decreasing state. At this time, the duty cycle is increased to a fifth preset duty cycle or the duty cycle is increased by a fifth amplitude, so that the temperature parameter of the heating element decreases slowly and then is converted to stable increase, thereby being closer to the preset temperature parameter of 200° C. If the current temperature parameter of the heating element changes to 195° C., 195.5° C., or 196° C., the temperature control condition is not met. The temperature parameter is lower than the preset temperature parameter and is in a rising state. At this time, the current duty cycle is maintained to make the temperature parameter rises steadily to get closer to the preset temperature parameter. If the current temperature parameter of the heating element changes to 205° C., 205.5° C., and 206° C., the temperature control condition is not met. The temperature parameter is greater than the preset temperature parameter and is in a rising state. At this time, the voltage output is cut off, the duty cycle is reduced by a sixth amplitude, or the duty cycle is reduced to a sixth preset duty cycle, so that the increase rate of the temperature parameter of the heating element is slowed down and then converted to a steady decrease, thereby being closer to the preset temperature parameter of 200° C. If the current temperature parameter of the heating element changes to 206° C., 205.5° C., and 205° C., the temperature control condition is not met, and the temperature parameter is greater than the preset temperature parameter and is in a decreasing state. At this time, the voltage output is cut off, the duty cycle is reduced to a seventh preset duty cycle, the duty cycle is reduced by a seventh amplitude, or the current duty cycle is maintained, so that the temperature parameter is steadily decreased to be closer to the preset temperature parameter. In this way, the adjustment process is stable and the temperature control effect is better.

In one embodiment, the temperature control method of the electronic cigarette in this embodiment may further include the following steps:

when the duty cycle is increased to a current corresponding preset duty cycle, the duty cycle is successively increased by a first preset amplitude;

when the duty cycle is reduced to a current corresponding preset duty cycle, the duty cycle is successively decreased by a second preset amplitude.

When a current corresponding preset duty cycle is determined as the adjustment target value according to the aforementioned judgment condition, if it is to increase the duty cycle, the duty cycle is successively increased to the current corresponding preset duty cycle by the first preset amplitude, that is to increase to the second preset duty cycle or the fifth preset duty cycle. In actual implementation, after each increase of the duty cycle, it is determined whether to continue to increase the duty cycle according to the feedback result of the temperature parameter of the heating element. Specifically, after the duty cycle is increased, if the temperature parameter of the heating element still maintains a downward trend, the duty cycle is continued to be increased; otherwise, the duty cycle is stopped to be increased and the temperature parameter of the heating element is continuously monitored.

If it is to reduce the duty cycle, the duty cycle is successively reduced to the corresponding preset duty cycle by the second preset amplitude, that is, it is reduced to the first preset duty cycle, the third preset duty cycle, the fourth preset duty cycle, the sixth preset duty cycle, or the seventh preset duty cycle. In actual implementation, after reducing the duty cycle each time, it is determined whether to continue to reduce the duty cycle according to the feedback result of the temperature parameter of the heating element. Specifically, after the duty cycle is reduced, if the temperature parameter of the heating element still maintains an increasing trend, the duty cycle is continued to be reduced; otherwise, the duty cycle is stopped to be reduced and the temperature parameter of the heating element is continuously monitored.

In the temperature control method of the electronic cigarette of the present disclosure, when a cigarette lighting signal is received, a preset maximum duty cycle is acquired as the initial duty cycle or the initial duty cycle is determined according to the current parameters of the electronic cigarette. Then, the battery voltage is adjusted according to the initial duty cycle and then output to the heating element to increase the temperature of the heating element, and a temperature parameter for characterizing the temperature of the heating element is acquired. When the temperature parameter of the heating element meets a preset temperature control condition, the duty cycle is adjusted according to the temperature parameter of the heating element so that the heating element retains its temperature. In this way, by using the preset maximum duty cycle as the initial duty cycle or determining the initial duty cycle according to the current parameters of the electronic cigarette, the heating element is heated; and when the preset temperature control condition is met, the duty cycle is adjusted according to the temperature parameter of the heating element so that the heating element retains its temperature. Therefore, the present disclosure can realize the effective control of the temperature of the heating element based on the performance of the electronic cigarette, ensure the suction effect and the suction safety, and improve the user experience.

Figure 2:
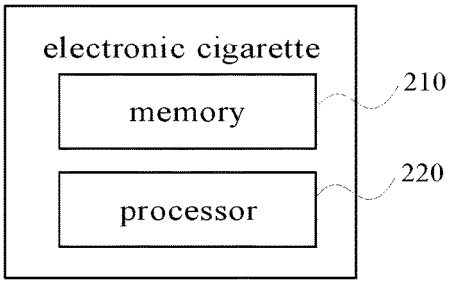
FIG. 2 is a schematic structural diagram of an electronic cigarette in an exemplary embodiment of the present disclosure.

FIG. 2 is a schematic structural diagram of an electronic cigarette in an exemplary embodiment of the present disclosure. As shown in FIG. 2, the present disclosure also provides an electronic cigarette, including a memory 210 and a processor 220. The memory 210 stores therein at least one program instruction. The processor 220 loads and executes the at least one program instruction to implement the temperature control method of the electronic cigarette as described above.

Please refer to the description of the embodiment shown in FIG. 1 for specific steps implemented when the at least one program instruction is executed by the processor 220 in this embodiment, which will not be repeated herein.

The present disclosure also provides a computer storage medium on which computer program instructions are stored; when the computer program instructions are executed by a processor, the above-mentioned electronic cigarette temperature control method is realized.

The computer storage media include: U disk, mobile hard disk, read-only memory (Read-Only Memory, ROM), random access memory (Random Access Memory, RAM), magnetic disk, optical disk, or cloud, etc., which can store program code medium.

Please refer to the description of the embodiment shown in FIG. 1 for the specific steps implemented when the computer program instructions stored in the computer storage medium are executed by the processor in this embodiment, which will not be repeated herein.

The embodiments described above are merely preferred embodiments, but not intended to limit the application. Any modifications, alternatives or improvements made within the principle and spirit of the present application should be interpreted as falling within the protection scope of the present application. The claims are not limited to the features or acts described above. Rather, the proper scope of the disclosure is defined by the appended claims.

What is claimed is:

1. A temperature control method of an electronic cigarette comprising:

when a cigarette lighting signal is received, acquiring a preset maximum duty cycle as the initial duty cycle or determining the initial duty cycle according to the current parameters of the electronic cigarette;

adjusting the battery voltage according to the initial duty cycle and outputting the battery voltage to a heating element to increase the temperature of the heating element;

acquiring a temperature parameter for characterizing the temperature of the heating element;

when the absolute value of the difference between the temperature parameter of the heating element and a preset temperature parameter is less than or equal to a preset threshold, comparing the temperature parameter of the heating element with the preset temperature parameter;

if the temperature parameter of the heating element is less than the preset temperature parameter, when the temperature parameter of the heating element is in a rising state, the current duty cycle is maintained, the duty cycle is reduced by a first amplitude, or the duty cycle is reduced to a first preset duty cycle; and when the temperature parameter of the heating element is in a decreasing state, the duty cycle is increased to a second preset duty cycle, or the duty cycle is increased by a second magnitude;

if the temperature parameter of the heating element is greater than the preset temperature parameter, when the temperature parameter of the heating element is in a rising state, the voltage output is cut off, the duty cycle is reduced by a third amplitude, or the duty cycle is reduced to a third preset duty cycle; and when the temperature parameter of the heating element is in a decreasing state, the voltage output is cut off, the duty cycle is reduced to a fourth preset duty cycle, the duty cycle is reduced by a fourth amplitude, or the current duty cycle is maintained;

if the temperature parameter of the heating element is equal to the preset temperature parameter, the current duty cycle is maintained.

2. The temperature control method of the electronic cigarette according to claim 1, wherein the current parameters of the electronic cigarette include the battery voltage and the preset temperature parameter, determining the initial duty cycle according to the current parameters of the electronic cigarette comprises the following steps:

detecting the battery voltage and acquiring the preset temperature parameter;

determining the initial duty cycle according to a preset relationship between the preset temperature parameter, the battery voltage and the duty cycle.

3. The temperature control method of the electronic cigarette according to claim 1, wherein the current parameters include the battery voltage, the preset temperature parameter and the preset maximum duty cycle, determining the initial duty cycle according to the current parameters of the electronic cigarette comprises the following steps:

detecting the battery voltage and acquiring the preset temperature parameter;

determining a temporary duty cycle according to a preset relationship between the preset temperature parameter, the battery voltage and the duty cycle;

if the difference between the temporary duty cycle and the preset maximum duty cycle is within a preset range, the preset maximum duty cycle is used as the initial duty cycle;

if the difference between the temporary duty cycle and the preset maximum duty cycle is outside the preset range, the temporary duty cycle is used as the initial duty cycle.

4. The temperature control method of the electronic cigarette according to claim 1, wherein the temperature control method further comprises the following steps:

when the absolute value of the difference between the temperature parameter of the heating element and the preset temperature parameter is greater than the preset threshold, comparing the temperature parameter of the heating element with the preset temperature parameter;

if the temperature parameter of the heating element is less than the preset temperature parameter, when the temperature parameter of the heating element is in the rising state, the current duty cycle is maintained; and when the temperature parameter of the heating element is in a decreasing state, the duty cycle is increased to a fifth preset duty cycle, or the duty cycle is increased by a fifth magnitude;

if the temperature parameter of the heating element is greater than the preset temperature parameter, when the temperature parameter of the heating element is in a rising state, the voltage output is cut off, the duty cycle is reduced by a sixth amplitude, or the duty cycle is reduced to a sixth preset duty cycle; and when the temperature parameter of the heating element is in a decreasing state, the voltage output is cut off, the duty cycle is reduced to a seventh preset duty cycle, the duty cycle is decreased by a seventh magnitude, or the current duty cycle is maintained.

5. The temperature control method of the electronic cigarette according to claim 1, wherein the temperature control method further comprises the following steps:

when the duty cycle is increased to a current corresponding preset duty cycle, the duty cycle is successively increased by a first preset amplitude;

when the duty cycle is reduced to a current corresponding preset duty cycle, the duty cycle is successively decreased by a second preset amplitude.

6. The temperature control method of the electronic cigarette according to claim 4, wherein the temperature control method further comprises the following steps:

when the duty cycle is increased to a current corresponding preset duty cycle, the duty cycle is successively increased by a first preset amplitude;

when the duty cycle is reduced to a current corresponding preset duty cycle, the duty cycle is successively decreased by a second preset amplitude.

7. The temperature control method of the electronic cigarette according to claim 1, wherein the temperature parameter is the temperature of the heating element, and acquiring the temperature parameter of the heating element comprises:

detecting the temperature of the heating element through a temperature sensor; or, detecting the voltage across the heating element to calculate the resistance value of the heating element according to the detected voltage, and determining the temperature of the heating element according to a corresponding relationship between the resistance value and the temperature.

8. An electronic cigarette comprising a memory and a processor, wherein the memory stores therein at least one program instruction, the processor loads and executes the at least one program instruction to implement the temperature control method of the electronic cigarette according to claim 1.

9. A computer storage medium, wherein computer program instructions are stored on the computer storage medium; when the computer program instructions are executed by a processor, the temperature control method of the electronic cigarette according to claim 1 is implemented.

* * * * *